US007360278B2

(12) United States Patent
Jang et al.

(10) Patent No.: US 7,360,278 B2
(45) Date of Patent: Apr. 22, 2008

(54) HOME-BAR DOOR OPENING/CLOSING DEVICE FOR REFRIGERATOR

(75) Inventors: Chan-Kyoo Jang, Changwon (KR); Byong-Yeul Kim, Changwon (KR); Soo-Beom Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 2 days.

(21) Appl. No.: 11/013,788

(22) Filed: Dec. 17, 2004

(65) Prior Publication Data

US 2005/0132535 A1 Jun. 23, 2005

(30) Foreign Application Priority Data

Dec. 19, 2003 (KR) ..... 10-2003-0093756
Dec. 19, 2003 (KR) ..... 10-2003-0093759
Dec. 24, 2003 (KR) ..... 10-2003-0096609

(51) Int. Cl.
*E05C 19/18* (2006.01)

(52) U.S. Cl. ..... 16/357; 16/348

(58) Field of Classification Search ..... 16/357, 16/50, 54, 341, 342; 62/265, 377; 312/405
See application file for complete search history.

(56) References Cited

U.S. PATENT DOCUMENTS 2,304,223 A * 12/1942 Westrope ..... 403/52
3,218,111 A * 11/1965 Steiner ..... 312/405.1
3,643,464 A * 2/1972 Hilliker et al. ..... 62/344
4,586,347 A * 5/1986 McCarty ..... 62/265
4,828,236 A 5/1989 Inoue
5,209,082 A * 5/1993 Ha ..... 62/265
5,651,536 A 7/1997 Daul
5,715,575 A * 2/1998 Kubota ..... 16/342
5,761,769 A * 6/1998 Bruckner et al. ..... 16/342
6,055,823 A * 5/2000 Baker et al. ..... 62/265
6,085,384 A 7/2000 Bivens
6,336,252 B1 * 1/2002 Bando ..... 16/307
6,817,064 B2 * 11/2004 Kim et al. ..... 16/335
6,922,869 B2 * 8/2005 Bivens et al. ..... 16/54
7,108,342 B2 * 9/2006 Shin et al. ..... 312/405
2001/0052741 A1 * 12/2001 Yun ..... 312/405
2003/0132689 A1 * 7/2003 Shin ..... 312/405
2004/0178710 A1 9/2004 Kim et al.

FOREIGN PATENT DOCUMENTS

EP 1 424 529 6/2005

(Continued)

*Primary Examiner*—Robert J. Sandy
(74) *Attorney, Agent, or Firm*—Ked & Associates LLP

(57) ABSTRACT

A home-bar door opening/closing device for a refrigerator. Guide slots 72 are provided in both side surfaces of an opening 59 provided in a refrigerator door 55 and connected to one ends of links 75 which rotate and vertically move. Then, a home-bar door 63 is installed in the opening 59 so that an upper end of the home-bar door 63 vertically rotates about a hinge 65. The other ends of the links 75 are pivotably connected to both side surfaces of the home-bar door 63, respectively. An upward elastic force from coil springs 77 is provided to the one ends of the links 75, while an elastic force from torsion springs 79 is provided to the other ends of the links 75. Accordingly, it is possible to reduce the impact due to the rapid opening of the home-bar door.

17 Claims, 14 Drawing Sheets

FOREIGN PATENT DOCUMENTS

| | | |
|---|---|---|
| EP | 1 691 153 | 8/2006 |
| JP | WO00/34679 | 6/2000 |
| KR | 10-2003-0009614 | 2/2003 |
| KR | 20-0322772 | 8/2003 |
| KR | 1020050062085 A | 6/2005 |
| WO | WO 03/062573 | 7/2003 |

* cited by examiner

HOME-BAR DOOR OPENING/CLOSING DEVICE FOR REFRIGERATOR

BACKGROUND OF THE INVENTION

1. Field of Invention

The present invention relates to a refrigerator, and more particularly, to a home-bar door opening/closing device for a refrigerator for selectively opening and closing a home-bar provided in the refrigerator.

2. Description of the Prior Art

FIG. 1 shows an external front appearance of a general side-by-side refrigerator. FIG. 2 shows a home-bar door opening/closing device according to a prior art.

As shown in the figures, a freezing chamber and a refrigerating chamber are formed side by side in a main body 11 of the side-by-side refrigerator, respectively. The freezing and refrigerating chambers are selectively opened and closed by freezing and refrigerating chamber doors 13 and 15 which are pivotably installed at both side ends of a front surface of the main body 11, respectively.

In general, a dispenser 17 for discharging ice or water to the outside is provided on a front surface of the freezing chamber door 13. An opening 19 is formed on a front surface of the refrigerating chamber door 15, while a storage space 21 is formed on a rear surface of the refrigerating chamber door 15 at a position corresponding to the opening 19. The storage space 21, in which a home-bar is formed and drinking water or the like is accommodated, is opened and closed by a home-bar door 23.

The home-bar door 23 is installed in the opening 19 of the refrigerating chamber door 15 so that an upper end of the home-bar door 23 vertically rotates about hinges 25. A handle portion 27 which a user holds by hand to rotate the home-bar door 23 is provided at an upper end of a front surface of the home-bar door 23. Reference numeral 29 designates a gasket 29 for preventing leakage of cold air.

Mounting grooves 19*a* are formed to vertically extend in both inner side surfaces of the opening 19. Each of the mounting grooves 19*a* is partially covered with a bracket 31. A guide slot 32 is formed in the bracket 31 to extend lengthwise, so that the mounting groove 19*a* is exposed to the outside. Each guide boss 33 is movably installed in the mounting groove 19*a* corresponding to the guide slot 32.

The guide boss 33 is connected to an end of a link 35, which will be described below, by a screw Sa penetrating the guide slot 32. Since the width of the guide boss 33 is larger than that of the guide slot 32, the guide boss 33 is not inadvertently removed to the outside although it freely moves within the mounting groove 19*a*.

The links 35, to which one ends of the guide bosses 33 are connected, serve to support the home-bar door 23 in a state where the home-bar door 23 rotates to open the storage space 21. The other ends of the respective links 35 are rotatably connected to rotating shafts 36, each of which is provided in a side surface of the home-bar door 23, by screws Sb.

In such a configuration, while the home-bar door 23 covers the storage space 21, an edge of a rear surface of the home-bar door 23 is in close contact with the gasket 29. The one ends of the links 35 are positioned at upper portions of the guide slots 32, and the links 35 are substantially parallel with the guide slots 32.

In order to open the home-bar door 23, a locking unit keeping the home-bar door 23 closed is released. Then, the storage space 21 is opened by rotating the home-bar door 23 counterclockwise with respect to the figure.

The home-bar door 23 is caused to rotate counterclockwise with respect to the figure by pulling the handle portion 27 held by hand to the front of the refrigerator to the extent of a certain inclination with respect to the front surface of the door 15 from the state where the home-bar door 23 covers the storage space 21. Then, after the home-bar door 23 reaches the certain inclination, the home-bar door 23 rotates counterclockwise due to its self weight. Here, a rotational speed of the home-bar door 23 increases.

In the meantime, due to the rotation of the home-bar door 23, the guide bosses 33 connected to the one ends of the links 35 move downwardly from the upper ends of the guide slots 32. Then, the other ends of the links 35 rotate about the rotating shafts 36 with respect to the home-bar door 23. If the one ends of the links 35 continue to move downwardly and are then positioned at lower ends of the guide slots 32, the home-bar door 23 stops rotating. In the state where the storage space 21 is completely opened as described above, it is preferred that the home-bar door 23 be in horizontal state.

However, the home-bar door opening/closing device according to the prior art so constructed has the following problems.

In the prior art, in the process of opening the storage space 21, the rotational speed of the home-bar door 23 increases due to its self weight after the home-bar door 23 rotates in the certain range. Therefore, there is a disadvantage in that noise occurs since the guide bosses 33 bump against the lower ends of the guide slots 32 or a lower end of the home-bar door 23 bumps against a portion of the door 15 while the home-bar door 23 rapidly rotates.

In addition, due to an impact occurring while the guide bosses 33 bumps against the lower ends of the guide slots 32 or the lower end of the home-bar door 23 bumps against the portion of the door 15, the guide slots 32 and guide bosses 33 or the door 15 and home-bar door 23 can be broken.

SUMMARY OF THE INVENTION

Accordingly, the present invention is conceived to solve the aforementioned problems in the prior art. An object of the present invention is to provide a home-bar door opening/closing device for a refrigerator capable of minimizing noise generation therefrom.

Another object of the present invention is to provide a home-bar door opening/closing device for a refrigerator that is configured so that the breakage of parts of the refrigerator can be prevented.

According to an aspect of the present invention for achieving the objects, there is provided a home-bar door opening/closing device for a refrigerator, comprising: a refrigerator door for opening and closing a storage space defined in a main body of the refrigerator, said refrigerator door including an opening formed through a portion thereof, said opening having both side surfaces provided with guide slots, respectively; a home-bar door installed in the opening so that an upper end thereof can be vertically rotated about a lower end thereof; a pair of links each of which includes one end rotating and moving along the guide slot and other end rotatably connected to a side surface of the home-bar door, respectively; guide bosses each of which moves in the guide slot according to the opening and closing of the home-bar door and rotatably connected to the one end of the link, respectively; and a first elastic member provided in the guide slot in order to provide an elastic force in a direction opposite to a direction in which the guide boss moves when the home-bar door is opened.

Preferably, the first elastic member, which comprises a coil spring, is provided in a lower portion of a mounting groove in the guide slot in which the guide boss is movably installed.

More preferably one end of the first elastic member is connected to the guide boss.

The present invention further comprising a second elastic member provided at a connection portion between the home-bar door and the link, the second elastic member providing an elastic force to the link in a direction opposite to a direction in which the links rotate when the home-bar door is opened.

The second elastic member comprises a torsion spring, a center of the torsion spring being penetrated by a rotating shaft through which the home-bar door and the link rotate relatively to each other, both ends of the torsion spring being supported by the home-bar door and the link, respectively.

According to another aspect of the present invention for achieving the objects, there is provided a home-bar door opening/closing device for a refrigerator, comprising: a refrigerator door for opening and closing a storage space defined in a main body of the refrigerator, said refrigerator door including an opening formed through portion thereof, said opening having both side surfaces provided with guide slots, respectively; a home-bar door installed in the opening so that an upper end thereof can be vertically rotated about a lower end thereof; a pair of links each of which includes one end rotating and moving along the guide slots and other end rotatably connected to a side surface of the home-bar door, respectively; and a damper for providing a force in a direction in which the home-bar door is prevented from opening.

Preferably, guide bosses, to which the one ends of the links are connected, are provided in the guide slots, the guide bosses lifting in the guide slots according to the opening and closing the home-bar door.

More preferably, the guide bosses are provided in guide portions which are seated in mounting grooves formed in the guide slots and lifted in the mounting grooves according to the opening and closing the home-bar door.

The damper, which is installed at a lower end in the guide slot, comprises a plunger providing the force in a direction opposite to a direction in which the one ends of the links move when the home-bar door is opened, and a damper housing in which a structure by means of which the plunger provides the force is provided and which the plunger protrudes out of and is inserted into.

According to another aspect of the present invention for achieving the objects, there is provided a home-bar door opening/closing device for a refrigerator, comprising: a refrigerator door for opening and closing a storage space defined in a main body of the refrigerator, said refrigerator door including an opening formed through a portion thereof; a home-bar door installed in the opening so that an upper end thereof can be vertically rotated about a lower end thereof; at least one damper for controlling a rotational speed of the home-bar according to an opening angle of the home-bar door, said damper including a rotating shaft positioned at a center of rotation of the home-bar door to serve as the center of rotation of the home-bar door.

Preferably, the damper comprising a damper housing in which a damping structure for controlling the rotational speed of the home-bar door is provided; and a rotating shaft connected to the damping structure in the damper housing and protruding out of the damper housing to serve as the center of rotation of the home-bar door.

More preferably the damper housing of the damper is installed in the home-bar door, the rotating shaft is inserted into an insertion hole formed in a side surface of the opening, and a portion of the rotating shaft protruding out of the damper housing is shaped corresponding to the insertion hole so as to be inserted and fixed into the insertion hole.

The insertion hole and the rotating shaft protruding out of the damper housing comprise elliptical cross sections The damping structure comprising a cam including at least two linear sections and an inclined section, and the home-bar door freely falls when a side of the rotating shaft is guided on the linear sections of the cam while the rotational speed of the home-bar door decreases due to the damping function of the damping structure when the side of the rotating shaft is guided on the inclined section of the cam.

The home-bar door freely falls by allowing the side of the rotating shaft to be guided on the linear sections of the cam in initial and last sections of the opening of the home-bar door, while the rotational speed of the home-bar door decreases by allowing the side of the rotating shaft to be guided on the inclined section of the cam in the other section.

The rotational speed of the home-bar door decreases due to the inclined section of the cam when an opening angle of the home-bar door is within a range of 20 to 80 degrees.

According to the home-bar door opening/closing device for the refrigerator of the present invention so configured, since the rotational speed of the home-bar door decreases, there is an advantage in that the impact that occurs when the home-bar door is reduced.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, preferred embodiments of a home-bar door opening/closing device for a refrigerator according to the present invention will be described in detail with reference to the accompanying drawings.

Figure 1:
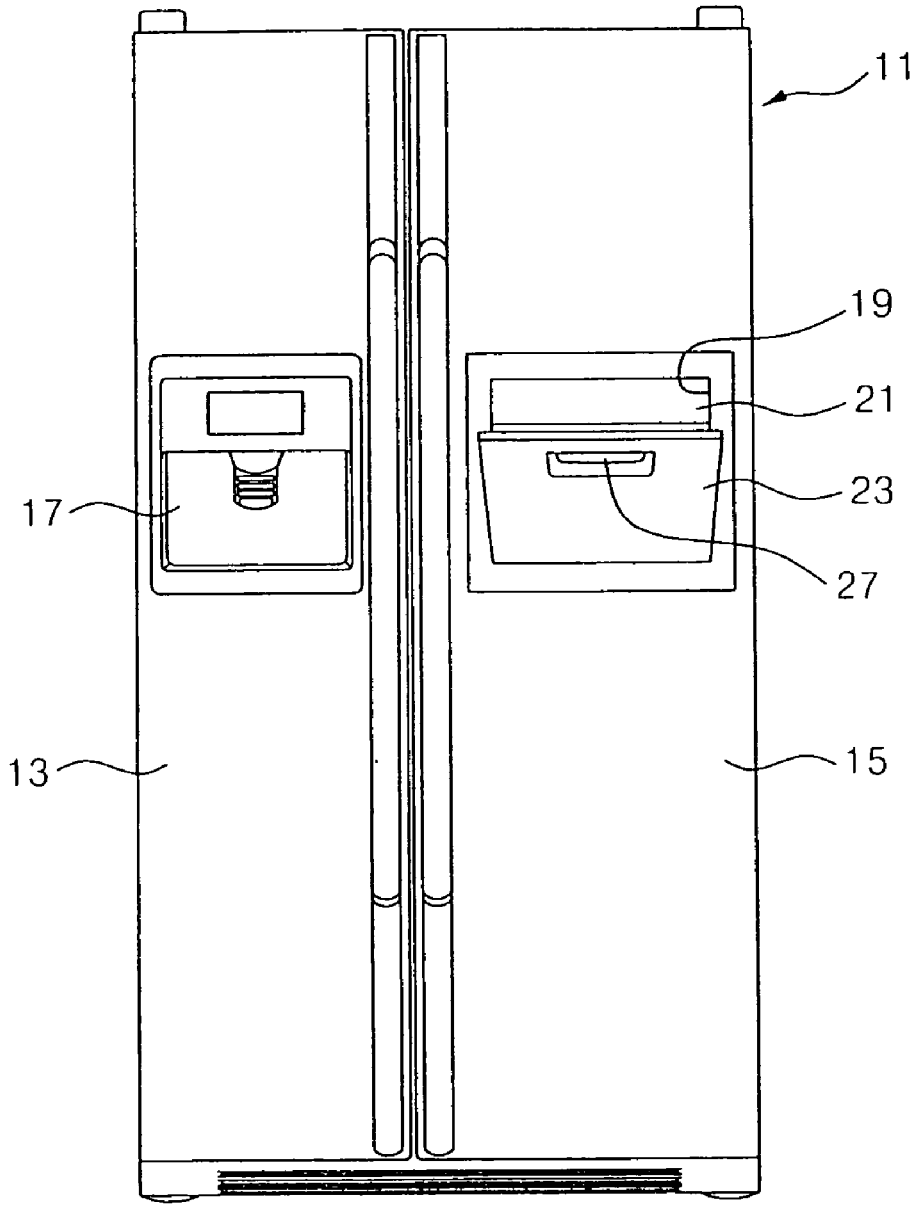
FIG. 1 Prior Art
FIG. 1 is a front view showing an external front appearance of a general side-by-side refrigerator.
Figure 2:
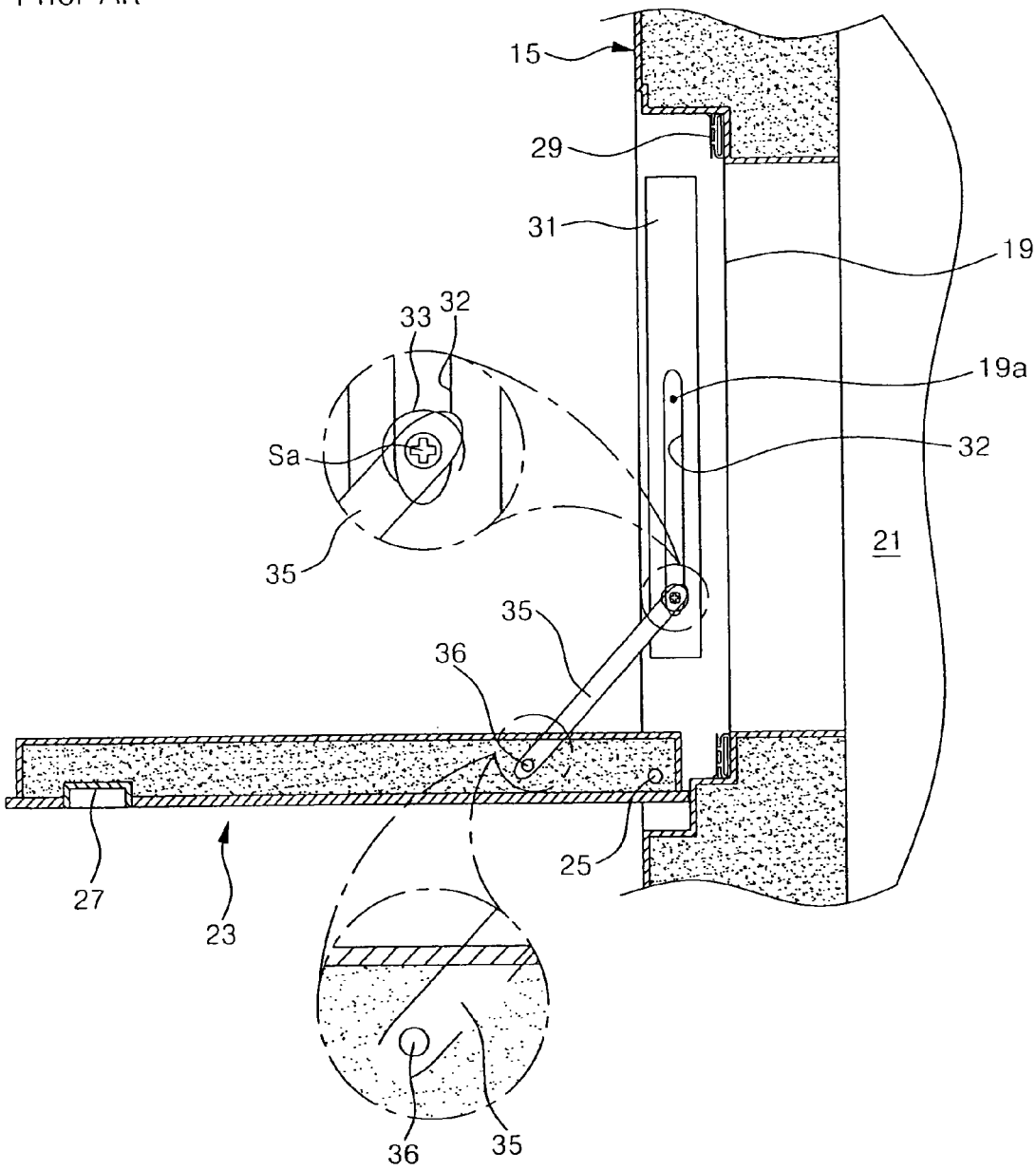
FIG. 2 Prior Art
FIG. 2 is a partial sectional side view showing a home-bar door opening/closing device according to a prior art.
Figure 3:
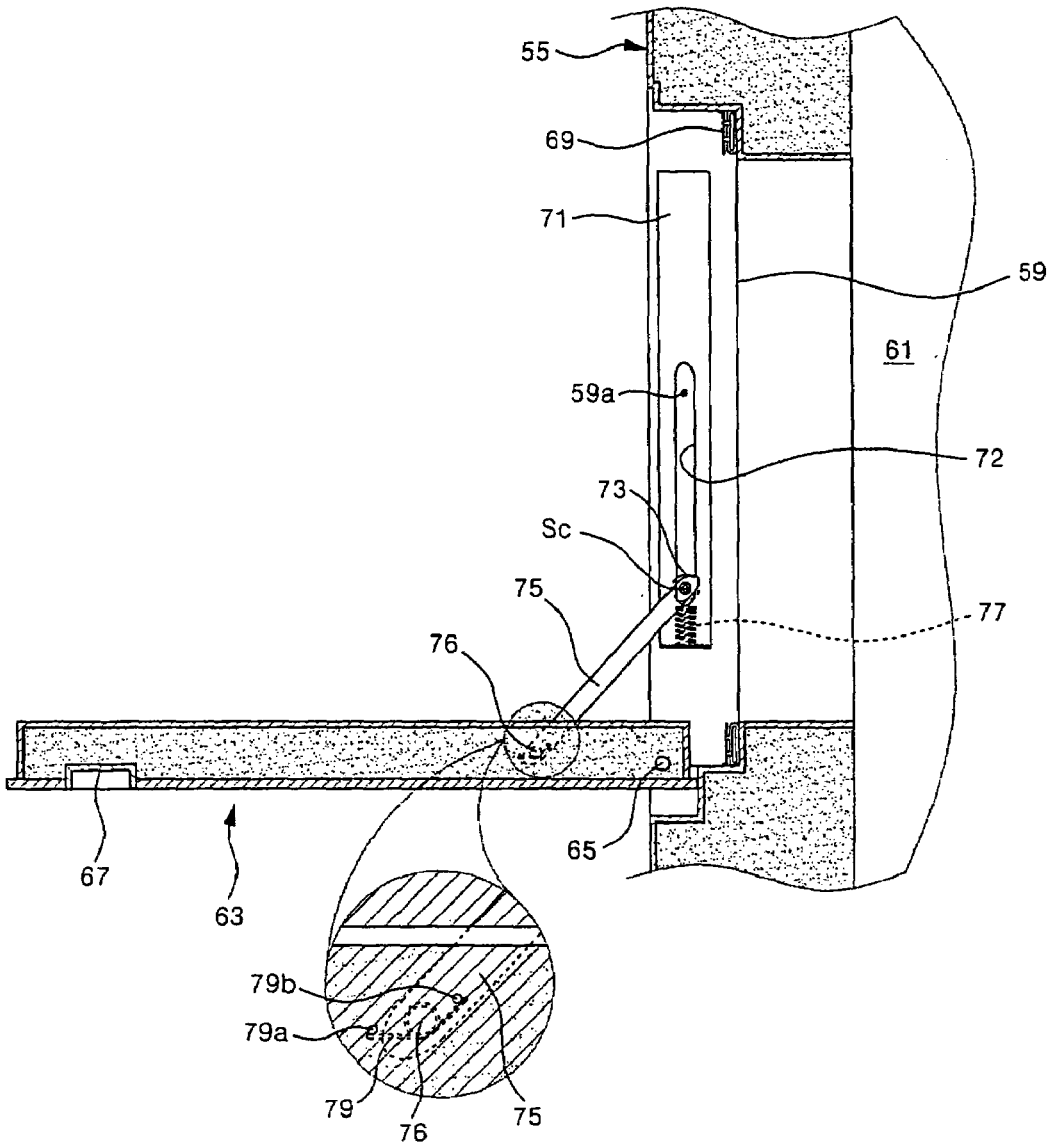
FIG. 3 is partial sectional side view showing a first embodiment of a home-bar door opening/closing device for a refrigerator according to the present invention, when the home-bar door is opened.
Figure 4:
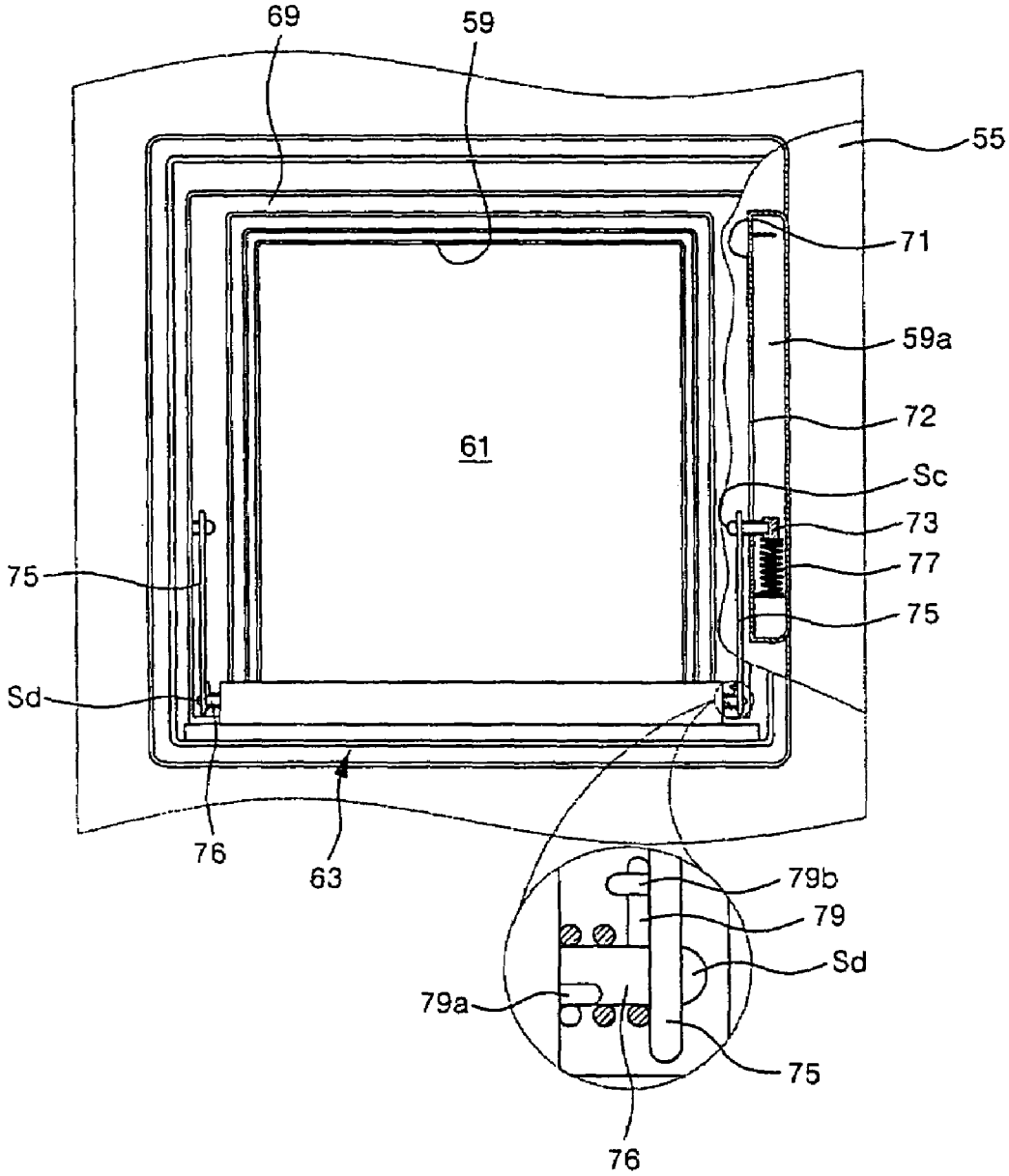
FIG. 4 is a sectional front view showing the first embodiment according to the present invention, when the home-bar door is opened.

FIG. 3 is a partial sectional side view showing a first embodiment of a home-bar door opening/closing device for a refrigerator according to the prestn invention, when the home-bar door is opened. FIG. 4 is a sectional front view showing the first embodiment according to the present invention, when the home-bar door is opened.

As shown in the figures, a refrigerator door 55 is provided with a home-bar which makes it possible to take out water or the like without opening the door 55. Such a home-bar comprises a storage space 61 provided in the rear of an opening 59 bored through the door 55 and a home-bar door 63 for selectively opening and closing the storage space 61.

The storage space 61, in which the water or the like is accommodated, is in communication with the outside via the opening 59 bored through the door 55. The home-bar door 63 is installed in the opening 59 rotatably about hinge shafts 65. Thus, the home-bar door 63 selectively opens and closes the storage space 61 by allowing an upper end of the home-bar door 63 to vertically rotate about the hinge shafts 65.

In addition, it is preferred that a front surface of the home-bar door 63 be provided with a handle portion 67 which a user holds by hand in order to rotate the home-bar door 63. A periphery of the opening 59 is provided with a gasket 69 for preventing leakage of cold air in the storage space 61.

Mounting grooves 59*a* are formed to vertically extend in both side surfaces of the opening 59. Each of the mounting grooves 59*a* is partially covered with a bracket 71. A guide slot 72 is formed to vertically extend in each bracket 71, so that the mounting groove 59*a* is partially exposed to the outside. The width of the guide slot 72 is formed to be smaller than that of the mounting groove 59*a*.

Guide bosses 73 are provided in the mounting grooves 59*a* corresponding to the guide slots 72, respectively. One end of each guide boss 73 passes through each guide slot 72 and is connected to one end of each link 75, which will be described below, by a screw Sc, while width of the other end of the guide boss 73 is formed larger than that of the guide slot 72. Thus, the guide bosses 73 are not detached inadvertently out of the mounting grooves 59*a*, and vertically move along the guide slots 72, respectively. In the present embodiment, only the guide bosses 73 are positioned in the mounting grooves 59*a*, but it is not necessarily limited thereto. That is, the guide boss 73 may be formed integrally with a part which is movable along the mounting groove 59*a* by opening and closing the home-bar door 63.

In the meantime, the one ends of the links 75 connected to the guide bosses 73 rotate in interconnection with the rotation of the home-bar door 63 and vertically move along the guide slots 72. The other ends of the links 75 are connected to both side surfaces of the home-bar door 63 by screws Sd to be rotatable about rotating shafts 76.

Coil springs 77 are provided in the mounting grooves 59*a* at positions corresponding to lower portions of the guide slots 72, respectively. The coil springs 77 serve to provide an elastic force to the guide bosses 73 in the direction opposite to the direction where the guide bosses move when the home-bar door 63 rotates to open the storage space 61.

Lower ends of the coil springs 77 are fixed to lower surfaces of the mounting grooves 59*a*. Then, upper ends of the coil springs 77 are positioned directly below the guide bosses 73 in a state where the home-bar door 63 closes the opening 59, that is, the guide bosses 73 are positioned at upper ends of the guide slots 72. If a stroke of the guide bosses 73 is not long, the upper ends of the coil springs 77 may be connected to the guide bosses 73.

In addition, connection portions between the home-bar door 63 and the links 75 are provided with torsion springs 79, respectively. The torsion springs 79 serve to provide an elastic force to the links 75 in the direction opposite to the rotation direction of the links 75 by the rotation of the home-bar door 63 for opening the storage space 61.

The torsion springs 79 are provided on the rotating shafts 76 which cause the links 75 to be connected to both the side surfaces of the home-bar door 63. Both ends of each of the torsion springs 79 are fixed to the home-bar door 63 and each of the links 75. To this end, both the side surfaces of the home-bar door 63 and side surfaces of the links 75 corresponding to each other are provided with fixing protrusions 79*a* and 79*b*, respectively.

Then, in a state where the home-bar door 63 covers the storage space 61, both the ends of each torsion spring 79 are parallel with each other with a predetermined space therebetween. In such a state, the links 75 are not subjected to the elastic force. However, if the home-bar door 63 rotates counterclockwise in FIG. 3 in order to open the storage space 61, both the ends of each torsion spring 79 are separated from each other to have a predetermined angle, so that the torsion springs 79 provide a certain elastic force to the links 75.

For reference, although the coil springs 77 and torsion springs 79 are provided on positions corresponding to the guide bosses 73 or positions where the links 75 are connected to the home-bar door 63 at both the side surfaces thereof, respectively, according to the present embodiment, the springs may be installed at only ones of the positions.

Furthermore, it is possible to control the opening speed of the home-bar door 63 using other types of springs in additional to the coil springs 77 and the torsion springs 79.

Hereinafter, the operation of the first embodiment of the present invention so constructed will be described in detail.

Figure 5:
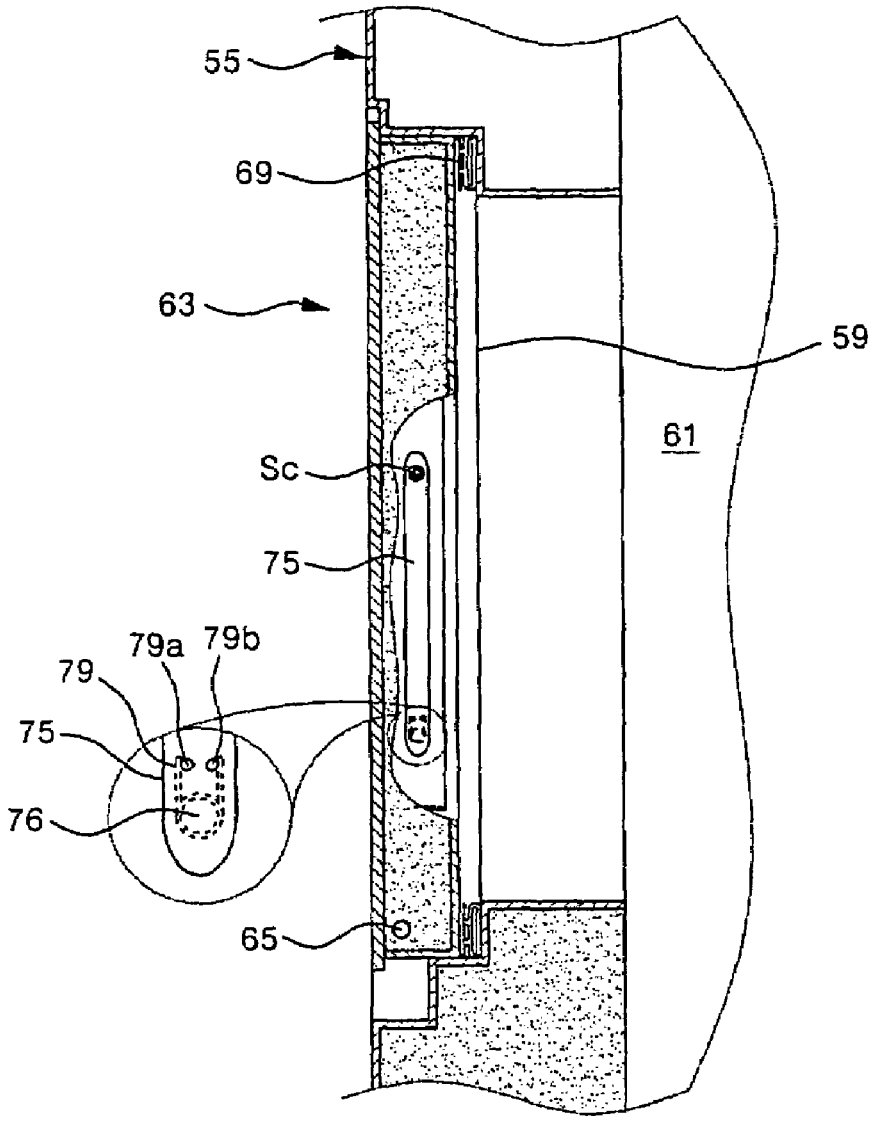
FIG. 5 is a partial sectional side view showing the first embodiment according to the present invention, when the home-bar door is closed.
Figure 6:
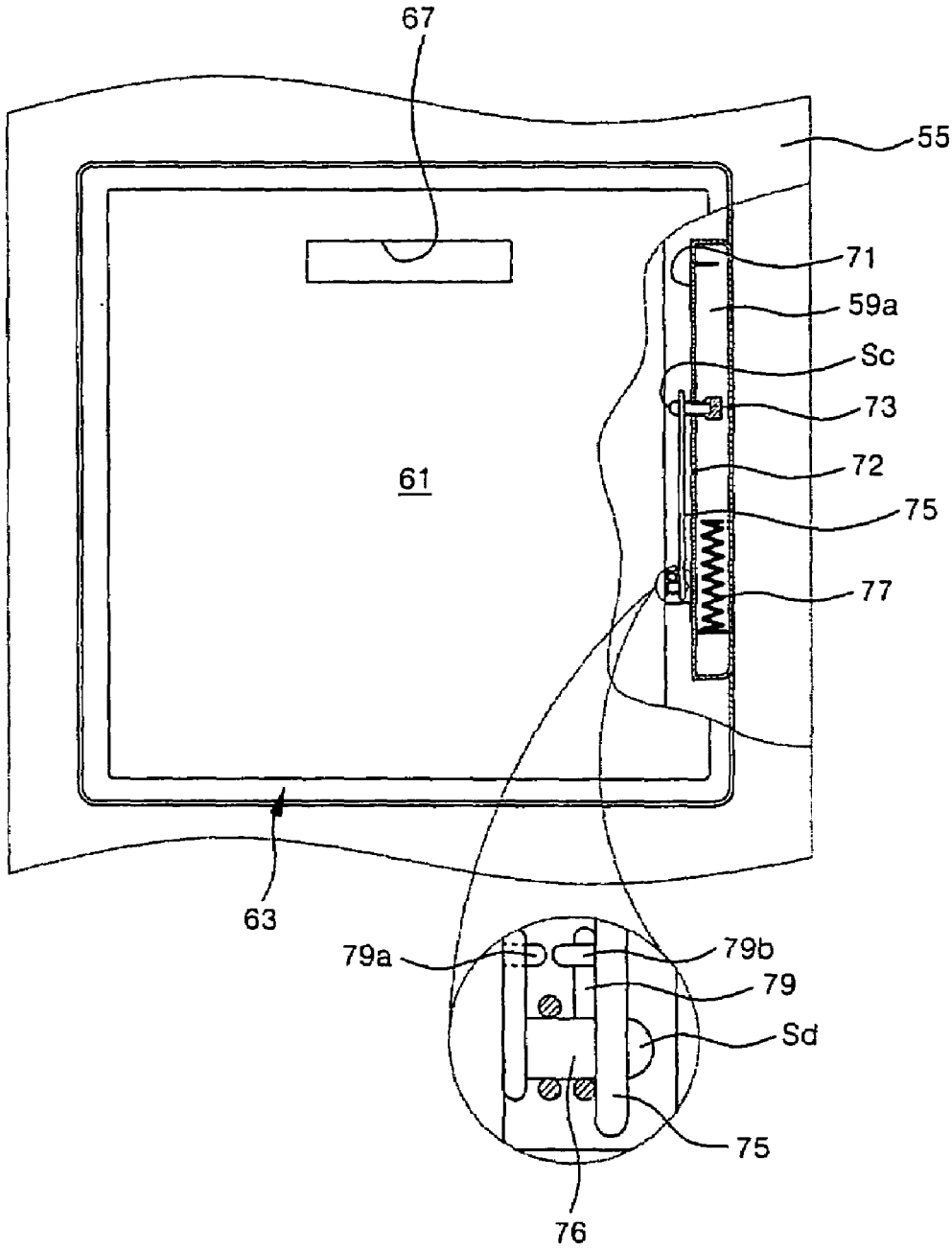
FIG. 6 is a partial sectional front view showing the first embodiment according to the present invention, when the home-bar door is closed.

First, as shown in FIGS. 5 and 6, in a state where the home-bar door 63 covers the storage space 61, the links 75 are substantially parallel with the guide slots 72. The one ends of the links 75 are positioned at the upper ends of the guide slots 72, respectively. Here, the coil springs 77 are positioned directly below the guide bosses 73, and both the ends of each of the torsion springs 79 are parallel with each other with the predetermined space therebetween, as shown in FIG. 5.

In such a state, a locking unit for keeping the storage space 61 covered with the home-bar door 63 is released. Next, the user holds the handle portion 67 of the home-bar door 63 by hand and draws it forward, so that the home-bar door 63 is changed from the state shown in FIG. 5 to the state shown in FIG. 3.

The state where the home-bar door 63 is opened is well shown in FIGS. 3 and 4. If the home-bar door 63 is opened, the storage space 61 is also opened. At this time, the one ends of the links 75, i.e., the portions of the links 75 connected to the guide bosses 73, rotate clockwise in the figure and simultaneously move downwardly along the guide slots 72. Further, the other ends of the links 75 rotate about the home-bar door 63 clockwise with respect to FIG. 3.

However, the rotation of the home-bar door 63 causes the guide bosses 73 to move to the lower portions of the mounting grooves 59*a*. When the guide bosses 73 move to the lower portions along the mounting grooves 59*a*, the coil springs 77 are pushed and compressed. Thus, the elastic force from the coil springs 77 is provided to the one ends of the links 75, that is, the guide bosses, upwardly, i.e., in the direction opposite to the moving direction of the guide bosses 73 caused from the rotation of the home-bar door 63.

In addition, the other ends of the links 75 rotate about the home-bar door 63 clockwise in the figure, so that both the ends of each of the torsion springs 79 are separated to get away from each other. Thus, the elastic force from the torsion springs 79 is provided to the other ends of the links 75 in the direction opposite to the rotation direction caused from the rotation of the home-bar door 63.

Due to such elastic forces, while the one ends of the links 75 are prevented from rapidly moving downward along the guide slots 72, the other ends of the links 75 are prevented from rapidly rotating about the home-bar door 63 clockwise in the figure. That is, the coil springs 77 and the torsion springs 79 prevent the home-bar door 63 from rapidly rotating.

Next, referring to FIG. 7, a second embodiment of the present invention will be described.

Figure 7:
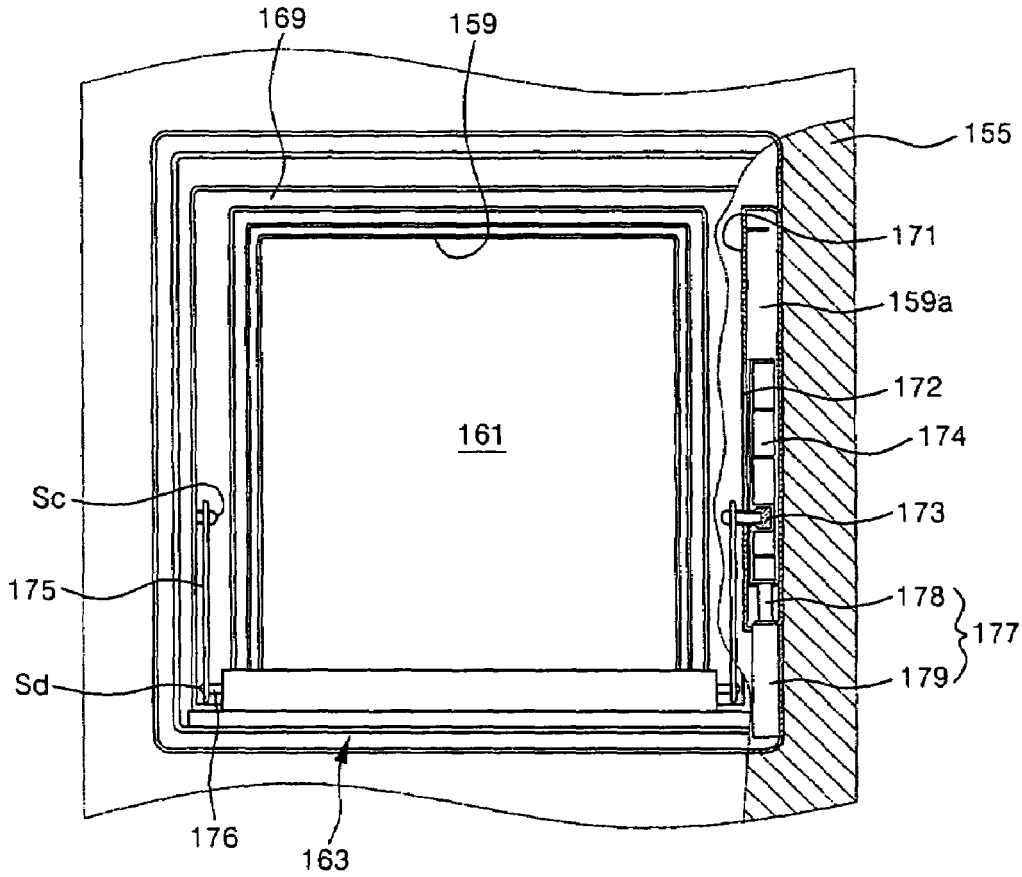
FIG. 7 is a partial sectional front view showing a second embodiment of the home-bar door opening/closing device for the refrigerator according to the present invention, when the home-bar door is opened.

FIG. 7 is a partial sectional front view of the second embodiment of the home-bar door opening/closing device for the refrigerator according to the present invention. According to the figure, a refrigerator door 155 is provided with a home-bar which makes it possible to take out water or the like without opening the door 155. That is, an opening 159 is bored through the door 155 and a rear side of the door 155 corresponding to a rear portion of the opening 159 is defined as a storage space 161. The storage space 161, in which the water or the like is accommodated, is in communication with the outside via the opening 159 provided in the door 155.

A home-bar door 163 is installed in the opening 159 in order to opening and closing the storage space 161. The home-bar door 163 is connected to the opening 159 rotatably about hinge shafts (not shown). The home-bar door 163 selectively opens and closes the storage space 161 by allowing an upper end of the home-bar door 163 to vertically rotate about a lower end thereof.

It is preferred that a front surface of the home-bar door 163 be provided with a handle portion 167 (see FIG. 8) which the user holds by hand in order to rotate the home-bar door 163. A periphery of the opening 159 is provided with a gasket 169 for preventing leakage of cold air in the storage space 161.

Mounting grooves 159*a* are formed to vertically extend in both side surfaces of the opening 159. Each of the mounting grooves 159*a* is partially covered with a bracket 171. A guide slot 172 is formed to vertically extend in each bracket 171. Guide bosses 173 are provided in the mounting grooves 159*a* corresponding to the guide slots 172, respectively. The width of the guide slot 172 is formed to be smaller than that of the mounting groove 159*a*.

One end of each guide boss 173 passes through each guide slot 172 and is fixed to one end of each link 175, which will be described below, by a screw Sc, while the other end of the guide boss 173 is fixed to a guide portion 174. The guide portions 174, which are movably installed in the mounting grooves 159*a*, vertically move in the mounting grooves 159*a* due to the rotation of the home-bar door 163 while the guide portions 174 are in close contact with the brackets 171.

The guide portions 174 are sized to the extent that the guide portions 174 are not detached through the guide slots 172 inadvertently. Thus, when the links 175 move, the guide portions 174 move only in the mounting grooves 159*a* and are not detached out of the mounting grooves 159*a* through the guide slots 172.

In the meantime, the one ends of the links 175 connected to the guide bosses 173 rotate in interconnection with the rotation of the home-bar door 163 and vertically move along the guide slots 172. The other ends of the links 175 are connected to both side surfaces of the home-bar door 163 by screws Sd to be rotatable about rotating shafts 176.

Dampers 177 are provided in the mounting grooves 159*a* at positions corresponding to lower portions of the guide slots 172, respectively. The dampers 177 provide a force to the guide portions 174 in the direction opposite to the direction in which the guide portions 174 move downward along the mounting grooves 159*a*, and thus, serve to prevent the home-bar door 163 from rapidly opening. That is, the dampers 177 serve to reduce falling impact of the guide portions 174 caused from the opening of the home-bar door 163.

Each of the dampers 177 comprises a plunger 178 moving downward by the guide portion 174 and a damper housing 179 provided with a structure for providing an elastic force to the plunger 178 upward. The structure provided in the damper housing 179 provides a force, which causes the plunger 178 to protrude out of the damper housing 179 in a normal state and prevents the plunger 178 from being accommodated in the damper housing 179. For example, with the damper housing 179 filled with fluid with large viscosity, the plunger 178 is configured so as to be subjected to the force which causes the plunger 178 to always protrude out of the damper housing 179 due to the fluid. Alternatively, the plunger 178 may be configured to be subjected to an elastic force in the direction in which the plunger 178 protrudes out of the damper housing 179 by an elastic member (not shown).

Hereinafter, the operation of the second embodiment of the present invention so constructed will be described in detail.

Figure 8:
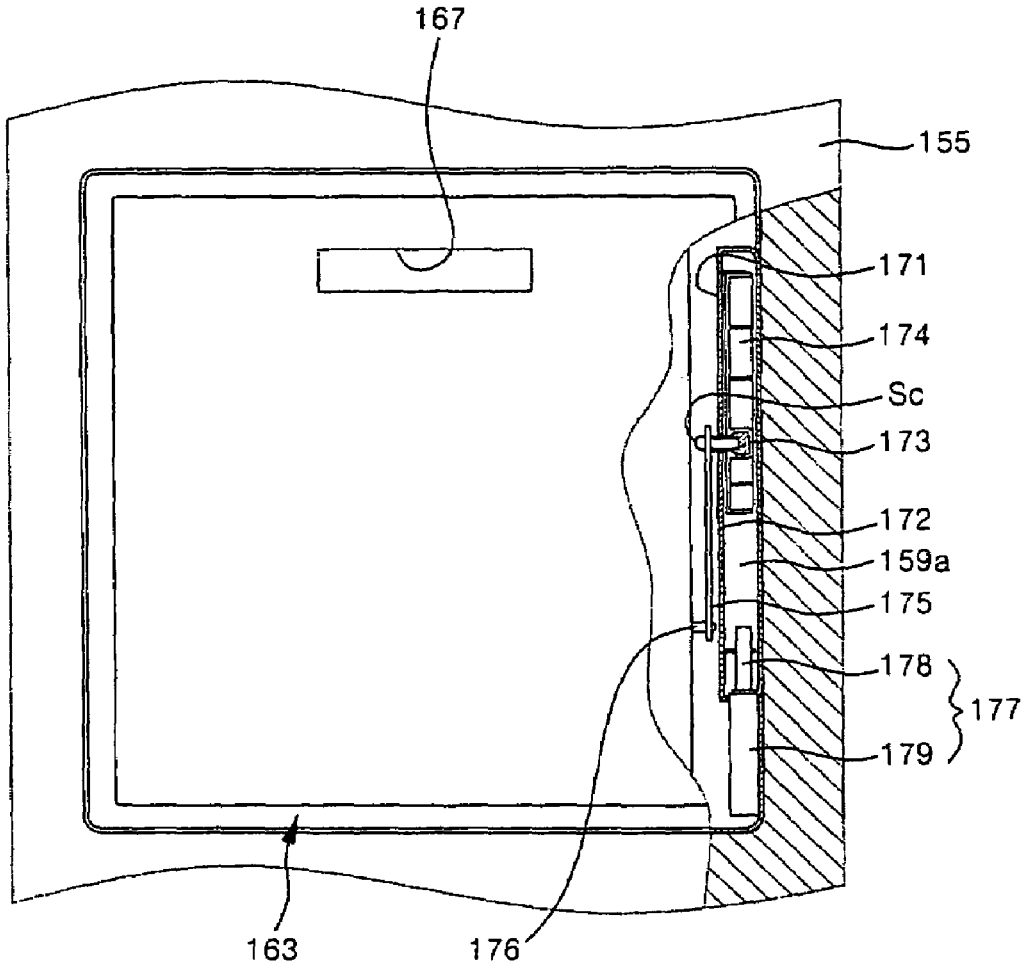
FIG. 8 is a partial sectional front view showing the second embodiment according to the present invention, when the home-bar door is closed.

First, FIG. 8 shows that the home-bar door 163 covers the storage space 161. Here, the links 175 are substantially parallel with the guide slots 172. The one ends of the links 175 are positioned at the upper ends of the guide slots 172, respectively.

In such a state, a locking unit for keeping the storage space 161 covered with the home-bar door 163 is released. Next, the user holds the handle portion 167 of the home-bar door 163 by hand and draws it forward, so that the home-bar door 163 rotates about the lower end thereof.

If the home-bar door 163 rotates, the storage space 161 is opened, as shown in FIG. 7. At this time, the one ends of the links 175 move to the lower portions of the guide slots 172. Of course, the guide portions 174, which move together with the one ends of the links 175, move to the lower portions of the mounting grooves 159*a*. The other ends of the links 175 rotate about the rotating shafts 176.

Due to the rotation of the home-bar door 163, the guide portions 174, which move along the guide slots 172 and are connected to the one ends of the links 175, respectively, also move downward. The movement of the guide portions 174 causes the plungers 178 of the dampers 177 to move downward.

However, since the plungers 178 tends to protrude out of the damper housings 179, the plungers 178 cause the downward movement speed of the guide portions 174 to decrease. Therefore, the rotational speed of the home-bar door 163 and the downward movement speed of the one ends of the links 175 in interconnection with the guide portion 174 decrease.

In the meantime, if the home-bar door 163 rotates in order to cover the opening 159, the plungers 178 protrude out of the damper housings 179. The protrusion of the plungers 178 out of the damper housings 179 is realized by viscous fluid or a mechanism in the damper housings 179.

Next, referring to FIGS. 9 to 11, a third embodiment of the present invention will be described below.

Figure 9:
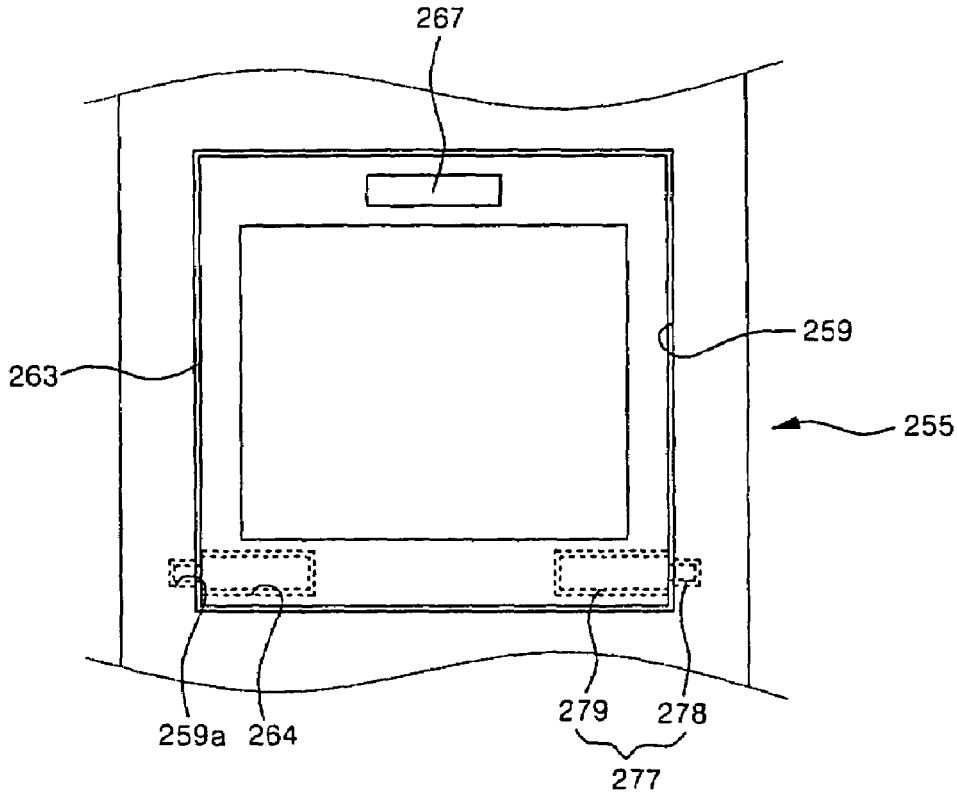
FIG. 9 is a front view showing a third embodiment of the home-bar door opening/closing device for the refrigerator according to the present invention.

FIG. 9 is a front view showing the third embodiment of the present invention. FIG. 10 is a sectional view showing the third embodiment of the present invention. FIG. 11 is a view of a profile of a cam employed in the third embodiment of the present invention.

As shown in the figure, a refrigerator door 255 is provided with a home-bar which makes it possible to take out water or the like without opening the door 255. That is, an opening 259 is bored through the door 255 and a rear side of the door 255 corresponding to a rear portion of the opening 259 is defined as a storage space 261. The storage space 261, in which the water or the like is accommodated, is in communication with the outside via the opening 259 provided in the door 255.

A home-bar door 263 is installed in the opening 259 in order to opening and closing the storage space 261. The home-bar door 263 is connected to the opening 259 rotatably about rotating shafts 278, which will be described below. The home-bar door 263 selectively opens and closes the storage space 261 by allowing an upper end of the home-bar door 263 to vertically rotate about a lower end thereof.

It is preferred that a front surface of the home-bar door 263 be provided with a handle portion 267 which the user holds by hand in order to rotate the home-bar door 263. A periphery of the opening 259 is provided with a gasket 269 for preventing leakage of cold air in the storage space 261.

Insertion holes 259*a* are concavely formed in both inner side surfaces of a lower portion of the opening 259. The rotating shafts 278 of dampers 277, which will be described below, are fixed in the insertion holes 259*a*. The respective insertion holes 259*a* are shaped corresponding to an external appearance of the rotating shafts 278.

Installation spaces 264 are provided in portions of the home-bar door 263 corresponding to the insertion holes 259*a* formed in both the inner side surfaces of the lower portion of the opening 259, that is, both side surfaces of a lower portion of the home-bar door 263, respectively. In addition, the installation spaces 264 are mounted with the dampers 277 for controlling the opening speed of the home-bar door 263, respectively.

The dampers 277 are seated in the installation spaces 264 of the home-bar door 263 and installed therein by allowing the rotating shafts 278 to be inserted into the insertion holes 259*a*. The rotating shafts 278 partially protrude out of damper housings 279 which are installed in the installation spaces 264.

The dampers 277 provide damping function according to a rotational angle of the home-bar door 263 and thus control the rotational speed of the home-bar door 263. A damping structure comprising a cam 280 is provided in the damper housing 279 defining an external appearance of each damper 277. The rotating shaft 278 protruding out of the damper housing 279 is connected to the damping structure.

Upon review of an interior of the damper 277, a side of the rotating shaft 278 may be guided along the cam 280, and the rotating shaft 278 may be in close contact with the cam 280 by an elastic member. Otherwise, the damper 277 may be configured so that the rotating shaft 278 is prevented from rotating by providing fluid with large viscosity in the damper housing 279.

In the meantime, in the present invention, the rotating shafts 278 are fixed in the insertion holes 259*a*. To this end, portions of the rotating shafts 278 inserted in the insertion holes 259*a* may have an elliptic cross section, as shown in the figure.

Next, referring to FIG. 11, the cam 280 will be described below. The cam 280 includes two linear sections X and Z and an inclined section Y provided between the linear sections X and Z. The home-bar door 263 freely falls if a side of each rotating shaft 278 or a portion connected thereto is guided on the linear sections X and Z, while the opening speed of the home-bar door 263 decreases due to the damping function if the side of the rotating shaft 278 is guided on the inclined section Y.

That is, the home-bar door 263 freely falls in initial and last sections of the rotation of the home-bar door 263 where the side of the rotating shaft 278 is guided on the linear sections X and Z. The rotational speed of the home-bar door 263 decreases due to the damping function in an intermediate section of the rotation of the home-bar door 263 where the side of the rotating shaft 278 is guided on the inclined section Y.

Hereinafter, the operation of the third embodiment of the present invention so constructed will be described in detail.

Figure 10:
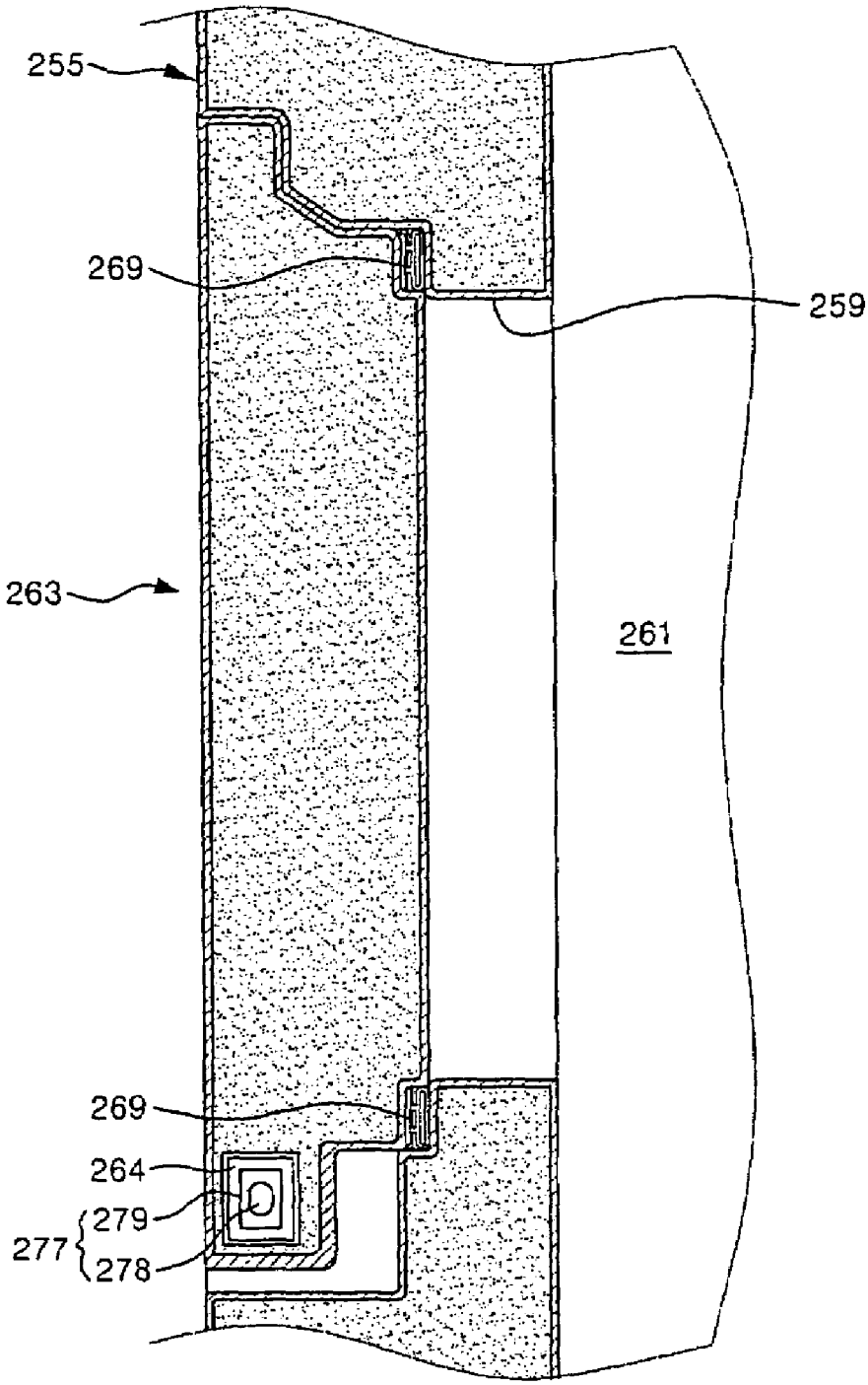
FIG. 10 is a sectional side view showing the third embodiment of the present invention, when the home-bar door is closed.
Figure 11:
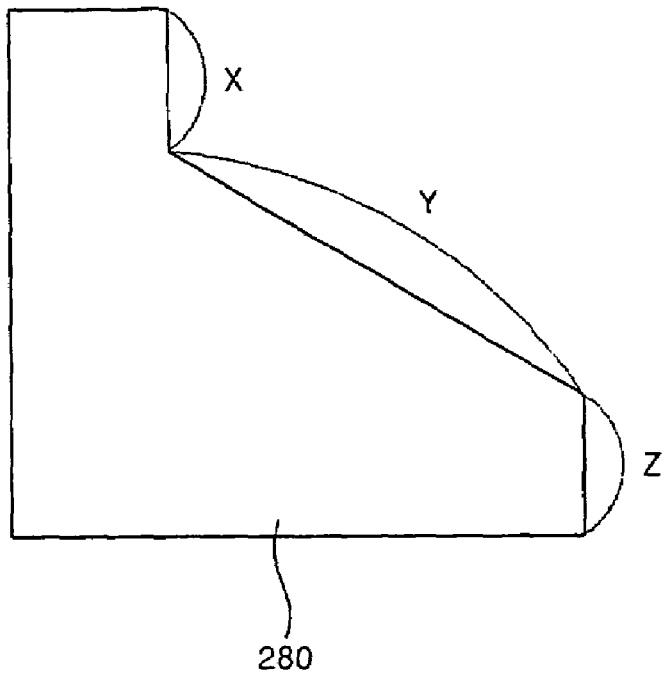
FIG. 11 is a view of a profile of a cam employed in the third embodiment of the present invention.

First, as shown in FIG. 10, a locking unit for keeping the storage space 261 covered with the home-bar door 263 is released. Then, the user holds the handle portion 267 and draws the home-bar door 263 to the left side in the figure. In such a section, the respective sides of the rotating shafts 278 are guided on the first linear sections X of the cams 280, respectively.

Figure 12A:
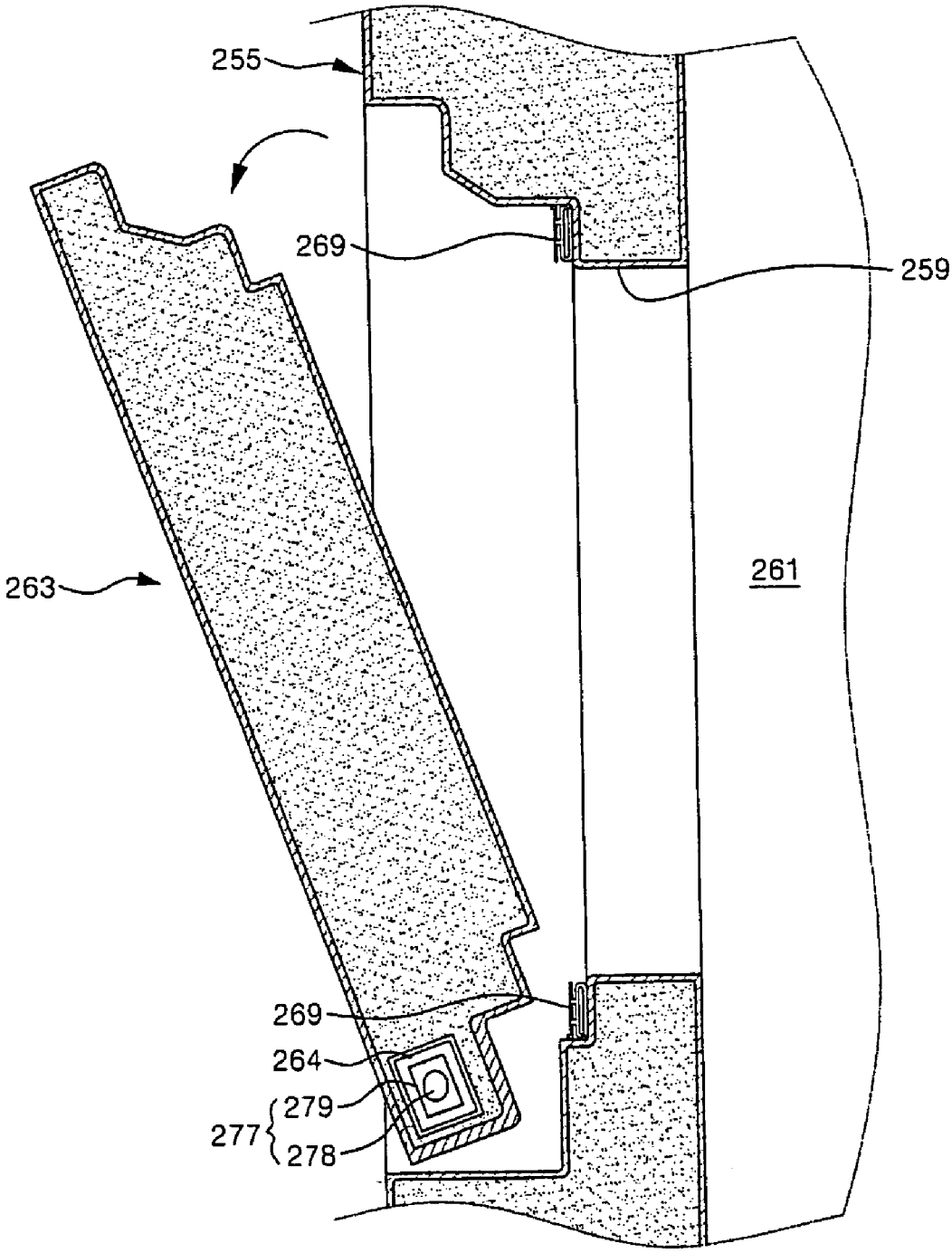
FIGS. 12*a* to 12*c* are views showing the operation of the third embodiment of the home-bar door opening/closing device for the refrigerator according to the present invention.

Thus, as shown in FIG. 12*a*, while the home-bar door 263 freely falls due to its own weight, the home-bar door 263 rotates about the rotating shafts 278 counterclockwise in the figure. The home-bar door 263 freely falls within a range of 0 to 20 degrees in view of its rotational angle with respect to a state where the home-bar door 263 covers the storage space 261.

Figure 12B:
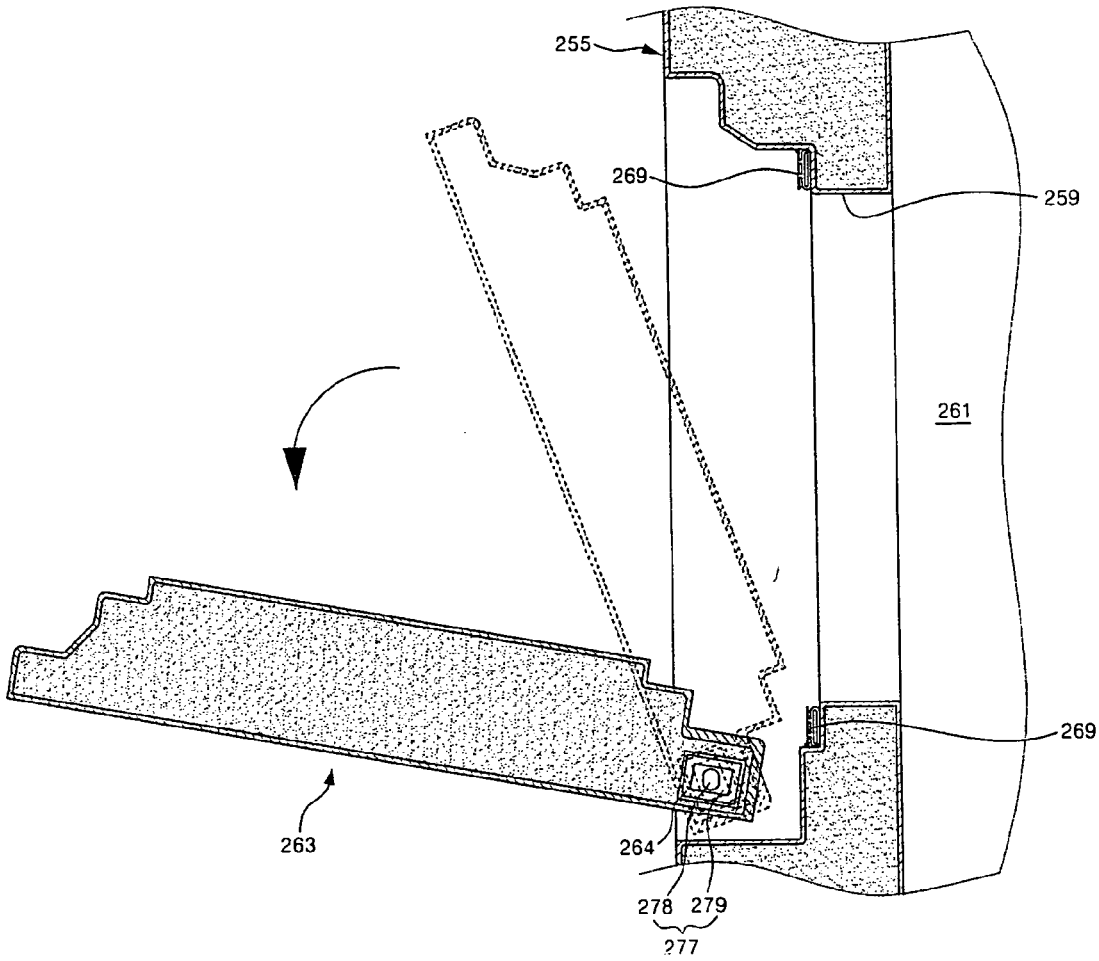

However, when the rotational angle of the home-bar door 263 exceeds 20 degrees, the portions connected to the rotating shafts 278 are guided on the inclined sections Y of the cams 280, respectively. Thus, the rotational speed of the home-bar door 263 decreases due to the damping function of the dampers 277. The damping function of the dampers 277 acts continuously until the rotational angle of the home-bar door 263 reaches about 80 degrees, as shown in FIG. 12*b*. That is, the rotational speed of the home-bar door 263 decreases due to the damping function of the dampers 277 when the rotational angle thereof is within a range of 20 to 80 degrees.

Figure 12C:
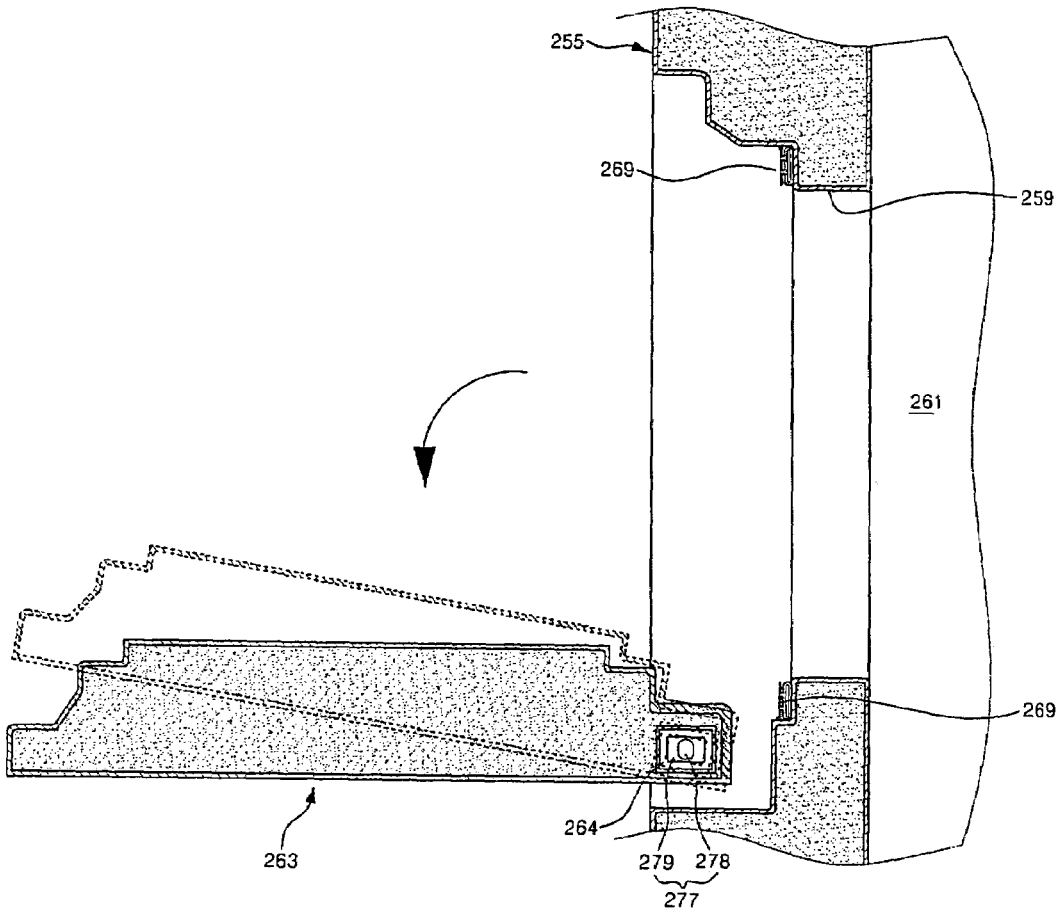

Next, as shown in FIG. 12*c*, the rotational angle of the home-bar door 263 exceeds 80 degrees, the sides of the rotating shafts 278 are guided on the second linear sections Z of the cams 280, respectively. Thus, the damping function of the dampers 277 stops and the home-bar door 263 freely falls due to its own weight again. Then, if the rotational angle of the home-bar door 263 reaches about 95 degrees, the home-bar door 263 stops and the storage space 261 are fully opened.

According to the home-bar door opening/closing device for the refrigerator of the present invention so constructed, the following advantages can be expected.

First, since the present invention causes the impact due to the rapid opening of the home-bar door to be absorbed and decrease, the noise generated from the impact can be effectively reduced.

In addition, according to the present invention, it is possible to expect an advantage in that a variety of parts of the refrigerator can be prevented from being damaged by the impact due to the rapid opening of the home-bar door.

Furthermore, in the present invention, since the home-bar door is not rapidly opened and is opened with the opening speed thereof controlled by the dampers, springs, or the like, there is an advantage in that the operational property of the refrigerator is more improved.

The scope of the present invention is not limited to the embodiments described and illustrated above but is defined by the appended claims. It will be apparent that those skilled in the art can make various modifications and changes thereto within the fundamental technical scope of the invention defined by the claims. Therefore, the true scope of the present invention should be defined by the technical spirit of the appended claims.

What is claimed is:

1. A home-bar door opening/closing device for a refrigerator, comprising:

a refrigerator door for opening and closing a storage space defined in a main body of the refrigerator, said refrigerator door including an opening formed through a portion thereof;

a home-bar door installed in the opening so that an upper end thereof can be vertically rotated about a lower end thereof;

at least one shaft mounted between the refrigerator door and the home-bar door, such that the home-bar door rotates about the at least one shaft; and at least one damper for controlling a rotational speed of the home-bar door, said damper including a cam surface that interacts with the at least one shaft to dampen rotational movement of the home-bar door, wherein the cam surface comprises at least two linear sections and an inclined section, and wherein the home-bar door freely rotates when a side of the at least one shaft is guided on the linear sections of the cam surface while the rotational speed of the home-bar door decreases due to the damping function of the damping structure when the side of the at least one shaft is guided on the inclined section of the cam surface.

2. The device as claimed in claim 1, wherein the at least one damper comprises a damper housing in which the cam surface is provided; and wherein the at least one shaft protrudes out of the damper housing to serve as the center of rotation of the home-bar door.

3. The device as claimed in claim 2, wherein the damper housing of the damper is installed in the home-bar door, the at least one shaft is inserted into an insertion hole formed in a side surface of the opening, and wherein a portion of the at least one shaft protruding out of the damper housing has a shape that corresponds to a shape of the insertion hole such that the at least one shaft will not rotate with respect to the refrigerator door.

4. The device as claimed in claim 3, wherein the insertion hole and the at least one shaft protruding Out of the damper housing comprise elliptical cross sections.

5. The device as claimed in claim 1, wherein the home-bar door freely rotates by allowing the side of the at least one shaft to be guided on the linear sections of the cam surface during an initial and last sections of the opening of the home-bar door, while the rotational speed of the home-bar door decreases by allowing the side of the at least one shaft to be guided on the inclined section of the cam surface during an intermediate stage of the opening of the home-bar door.

6. The device as claimed in claim 5, wherein the rotational speed of the home-bar door decreases due to the inclined section of the cam surface when an opening angle of the home-bar door is within a range of 20 to 80 degrees relative to the refrigerator door.

7. A damping device for a home-bar door which is mounted in a refrigerator door of a refrigerator, comprising;

a damper housing mounted on one of the home-bar door and the refrigerator door;

a cam surface mounted in the damper housing, wherein the cam surface acts to dampen rotational movements of the home bar door as it opens and closes and wherein the cam surface includes a linear section and an inclined section; and a shaft connected to the damper housing and to the refrigerator door, wherein the home-bar door rotates about the shaft, wherein the shaft interacts with the cam surface such that the home bar-door rotates freely when a side of the shaft is guided on the linear section of the cam surface, and wherein rotation of the home-bar door is damped when the side of the shaft is guided on the inclined section of the cam surface.

8. The device as claimed in claim 7, wherein a portion of the shaft protrudes out of the damper housing, and wherein the protruding portion of the shaft is inserted into an insertion hole formed in the other of the home-bar door and the refrigerator door.

9. The device as claimed in 8, wherein the insertion hole and the protruding portion of the shaft each have a cross-sectional shape that prevents the shaft from rotating with respect to the insertion hole.

10. The device as claimed in claim 7, wherein the rotation of the home-bar door is damped due to the interaction between the inclined section of the cam and the shaft when an opening angle of the home-bar door is within a range of 20 to 80 degrees relative to the refrigerator door.

11. The device as claimed in claim 7, wherein the damper housing is mounted in the home-bar door, and wherein a portion of the shaft protruding from the damper housing is mounted in an insertion hole formed in the refrigerator door.

12. The device as claimed in claim 11, wherein the protruding portion of the shaft and the insertion hole have cross-sectional shapes that prevent the shaft from rotating in the insertion hole.

13. The device as claimed in claim 12, wherein the shaft interacts with the cam surface to dampen rotational movement of the home-bar door because the cam surface rotates with the home-bar door as it rotates, while the shaft does not.

14. The device as claimed in claim 13, wherein the cam surface includes a first portion and a second portion, wherein the shaft interacts with the first portion of the cam surface during initial rotation of the home-bar door as it opens, and wherein the shaft interacts with the second portion of the cam surface during intermediate rotation of the home bar door as it opens.

15. The device as claimed in claim 14, wherein the damper provides a first amount of rotational dampening force when the shaft interacts with the first portion of the cam surface, and wherein the damper provides a second, greater amount of rotational dampening force when the shaft interacts with the second cam surface.

16. The device as claimed in claim 15, wherein the cam surface includes a third portion, and wherein the shaft interacts with the third portion of the cam surface during final rotation of the home-bar door as it opens.

17. The device as claimed in claim 16, wherein the damper provides a third amount of rotational damping force as the shaft interacts with the third portion of the cam surface.

* * * * *